United States Patent [19]

Sturwold

[11] 4,132,662

[45] Jan. 2, 1979

[54] ROLLING OIL FOR ALUMINOUS METALS

[75] Inventor: Robert J. Sturwold, Cincinnati, Ohio

[73] Assignee: Emery Industries, Inc., Cincinnati, Ohio

[21] Appl. No.: 867,107

[22] Filed: Jan. 5, 1978

[51] Int. Cl.[2] ..... C10M 1/24; C10M 3/18; C10M 5/12; B21B 45/02

[52] U.S. Cl. ..... 252/56 R; 72/42

[58] Field of Search ..... 252/56 R; 72/42

[56] References Cited

U.S. PATENT DOCUMENTS

| | | | |
|---|---|---|---|
| 3,180,832 | 4/1965 | Furey | 252/56 R |
| 4,042,515 | 8/1977 | Van Zalm | 252/56 R |
| 4,075,393 | 2/1978 | Sturwold | 252/56 R |

*Primary Examiner*—Delbert E. Gantz
*Assistant Examiner*—Irving Vaughn
*Attorney, Agent, or Firm*—Gerald A. Baracka; John D. Rice

[57] ABSTRACT

Improved rolling oil compositions are obtained by blending a petroleum base oil with a polymeric fatty acid, a fatty alcohol and lower alkyl ester of a fatty acid. These formulations are extremely effective for use in the cold rolling of aluminum and aluminum alloys.

9 Claims, No Drawings

ROLLING OIL FOR ALUMINOUS METALS

BACKGROUND OF THE INVENTION (1) Field of the Invention

This invention relates to the lubrication of aluminum and aluminum alloy surfaces during cold forming operations, such as cold rolling, and to rolling oil compositions suitable for such use. More particularly, this invention relates to improved rolling oil lubricant compositions having superior loadbearing (EP) properties which produce smooth uniform sheets free of surface defects, and which are non-staining and form a protective barrier on the surface of the metal.

(2) Description of the Prior Art

Lubricants are typically employed in cold forming processes to prevent damge to the surface of the metal and to generally facilitate the operation. It has been the general practice when cold rolling aluminum to apply a light petroleum-based oil, such as mineral oil, containing a small amount of an additive. These impart a number of desirable properties to the rolling oil but their primary function is to insure that sheets of uniform thickness and free from objectionable surface defects are obtained. A wide variety of lubricant compositions have been developed for this purpose but many of these formulations stain the metal immediately upon application or during the annealing operation. It would be highly advantageous, therefore, if rolling oil compositions were available for use with aluminum and aluminum alloys which exhibit excellent lubrication properties and do not produce undesirable surface stain.

SUMMARY OF THE INVENTION

I have now quite unexpectedly discovered improved lubricant compositions suitable for use as rolling oils for aluminous metals which produce bright, unstained metal sheet free of surface defects. In addition to their non-staining character, the rolling oil compositions of this invention also exhibit superior lubricating properties and provide a protective coating on the surface of the aluminum or aluminum alloy so that the surface of the metal is resistant to water staining during subsequent storage and/or shipment.

The improved rolling oil lubrication compositions of this invention are comprised of a petroleum oil base stock containing from about 1 to 20, and more preferable 3 to 10, weight percent of an additive consisting of:

(a) from about 25% to 65% by weight of a polymeric fatty acid and preferably a dibasic acid containing greater than 75% by weight $C_{36}$ dibasic acid and having a maximum iodine value of 35;

(b) from about 15% to 45% by weight of a fatty alcohol having 8 to 20 carbon atoms and more preferably a saturated alcohol having from 10 to 18 carbon atoms, or mixtures thereof; and (c) from about 15% to 45% by weight of a lower alkyl ester of a fatty acid having from 12 to 18 carbon atoms and more preferably a methyl ester of $C_{14-18}$ fatty acids or mixtures of said fatty acids.

DETAILED DESCRIPTION

The improved rolling oil compositions of this invention consist of a major proportion of a petroleum-based oil and a minor amount of an additive consisting of (a) a polymeric fatty acid, (b) a fatty alcohol having 8 to 20 carbon atoms or mixture of said alcohols and (c) an alkyl ester of a $C_{12-18}$ fatty acid or mixture thereof.

A polymeric fatty acid is a necessary and essential component of the rolling oil compositions of this invention. Useful polymeric fatty acids are obtained by the polymerization of unsaturated monocarboxylic acids containing from 16 to 20 carbon atoms. Dimer acids obtained by the dimerization of oleic acid, linoleic acid or mixtures thereof (e.g. tall oil fatty acids) and which have as their principle component a $C_{36}$ dibasic acid are especially useful. Such $C_{36}$ dibasic acids are commerically available under the trademark EMPOL ® Dimer Acids. Dimer acids containing greater than 75% by weight and preferably more than 90% by weight, $C_{36}$ dibasic acid and which have a maximum iodine value of 35, and preferably not greater than 20, have been found to provide especially useful rolling oil compositions. Typically, in addition to the prescribed $C_{36}$ dibasic acid content and iodine value, these dimer acids will have an acid value between about 180–215, saponification value from 190–205 and neutral equivalent of about 265–300.

A fatty alcohol having 8–20 carbon atoms is included with the polymeric fatty acid. Fatty alcohols suitable for this purpose are aliphatic alcohols and are typically straight-chain, that is, contain no alkyl branching within the molecule. Suitable alcohols include but are not limited to nonyl alcohol, lauryl alcohol, myristyl, alcohol, cetyl alcohol, stearyl alcohol, oleyl alcohol, and linoleyl alcohol and mixtures thereof. Preferably, the fatty alcohols are saturated alcohols and have from 10–18 carbon atoms. Especially useful in view of their commerical availability are mixtures of said fatty alcohols.

The alkyl ester is derived from the fatty acid having from 12 to 18 carbon atoms. Lower alkyl esters of these acids, that is, where the alkyl group contains from about 1–4 carbon atoms, are especially advantageous for the formulation of the rolling oil compositions of this invention. Methyl esters are particularly advantageous and especially useful are methyl esters of $C_{14}$ and $C_{18}$ fatty acids or mixtures of these fatty acids. Typically, the fatty acids will be saturated, however, unsaturation can be present in the fatty acid moiety without adversely affecting the desirable properties of the rolling oil composition.

From about 25% to 65% by weight, and more preferably 30 to 60 weight percent, of the polymeric fatty acid is used to obtain the improved rolling oil compositions of this invention. These weight percentages are based on the total additive package and do not include the petroleum base oil. The fatty alcohol constitutes 15% to 45% by weight, and more usually 20% to 40% by weight, of the rolling oil additive. The alkyl ester component in the additive mixture is present from about 15 to 45 weight percent but more usually will constitute from about 20 to 40 weight percent.

If the above-described components are present in the prescribed weight ratios, a multi-functional additive which provides excellent lubrication and a high surface finish is obtained. Furthermore, it has quite unexpectedly been found that rolling oil compositions formulated with these additive packages do not produce oil staining upon application or during subsequent annealing operations or if some staining is observed it is insignificant. Even more surprisingly the surface of the so-treated aluminum or aluminum alloys are protected against water staining which can occur during storage or shipment.

The three-component additive package consisting of the polymeric fatty acid, fatty alcohol and alkyl ester of a fatty acid is typically combined with a light petroleum base oil which serves as a diluent, facilitates application of the additive onto the metal surface and also imparts useful lubrication properties. Useful petroleum oils, which can be either aliphatic or contain aromatic hydrocarbons, will have 100° F. viscosities of 20 to 100 SUS. More usually, these base oils will have 100° F. viscosities between 25 and 60 SUS. Typically, they have flash points above 115° F. and more generally greater than 175° F. Hydrocarbon oils designated as mineral oils or mineral seal oils are especially useful for the preparation of multi-purpose rolling oil compositions of this invention. Synthetic hydrocarbon oils obtained by oligomerizing olefins having up to 20 carbon atoms in the presence of peroxide or Friedel-Crafts catalysts can also be employed. Additional additives such as stabilizers, fungicides, bacteriocides and the like can also be included in the rolling oil formulation. The concentration of the additive package in the hydrocarbon oil will range from about 1 to 20 weight percent, however, the additive more usually is present from about 3% to 10%. Using such concentrations rolling oil compositions exhibiting extremely desirable performance characteristics are obtained.

The rolling oils of this invention are suitable for use with aluminum and a wide variety of aluminum alloys generally containing 80% by weight or more aluminum. The formulated oil can be applied to the surface of the metal employing conventional procedures such as dipping, brushing, spraying, wiping, coating with a roller, or the like.

Typically, a rolling oil composition based on mineral oil or mineral seal oil containing from about 4 to 7 weight percent of an additive comprising $C_{36}$ dimer acid, $C_{10-18}$ saturated fatty alcohol and methyl ester of a $C_{14-18}$ fatty acid will have the following properties:

Acid Vaue: $<10$
210° F. Viscosity: 0.5–2 Centistokes
100° F. Viscosity: 8–12 Centistokes
Flash Point: $>260°$ F.
Fire Point: $>290°$ F.
Pour Point: $-50°$ F. or above The following examples and data illustrate the invention more fully, however, they are not intended as a limitation on the scope thereof. All parts and percentages are on a weight basis unless otherwise indicated. These examples illustrate the novel rolling formulations and the numerous variations possible therewith. The utility of these products with aluminum and aluminum alloys is also demonstrated.

to demonstrate staining resistance 0.1 ml. of the rolling oil is placed in a small aluminum dish with 0.1 ml. of a 50/50 toluene-isopropanol solution and heated in a muffle furnace at 650° F. for 30 minutes. The dishes are then visually examined and rated from 0 to 5 (0 indicates no stain; 5 indicates a heavy brownish/black stain).

Water stain protection is measured by applying several drops of the rolling oil sample to a 3 inches × 6 inches solvent-washed panel stampled from rolled aluminum sheet. The oil is uniformly spread over the entire surface of the panel and the weight adjusted by wiping with a soft tissue so that approximately 0.0075 grams of the oil remain. The test panels are then perpendicularly mounted 0.5 inch from the sidearm of a 500 ml. stoppered suction flask. Steam is generated by vigorously boiling water in the flask and the steam is directed onto the panel through the side-arm for a period of five minutes. The panel is then removed, allowed to dry and visually rated for water stain development using a 0 to 5 rating system (0 indicates no stain; 5 indicates a water stain having a diameter greater than 1 inch).

Lubricating properties of the formulations are determined using a modified Falex wear test procedure. A standard steel pin and aluminum V-block assembly are employed. Wear readings are taken at 100, 500, 750, 1000, 1250 and 1500 pound loadings. The sum of these readings are reported as the "units of wear". The test is then completed by continuously increasing the load by engaging the ratchet until failure and this is reported as the "EP" value for the sample.

A rolling oil composition was obtained by blending 50 parts EMPOL ® 1012 Dimer Acid (87% $C_{36}$ dibasic acid, 3% $C_{54}$ tribasic acid and 10% monobasic acid) with 30 parts methyl stearante and 20 parts mixed saturated fatty alcohols containing 85% lauryl alcohol. The resulting blend had an acid value 89.7, hydroxyl value 55.0, 210° F. viscosity 8.5 centistokes, 100° F. viscosity 58.4 centistokes, flask point 315° F., cloud point 50° F., pour point 35° F. and specific gravity (25° C.) 0.887. A 4% solution of the blend was prepared with 40 SUS mineral seal oil and the rolling oil compositions evaluated for lubricity, water stain and oil stain in accordance with the above-described procedures. Two hundred and forty-seven units wear was recorded in the Falex test and in the EP phase of the test the product withstood testing up to 3,000 lbs. No staining was observed upon application of the formulation onto freshly rolled aluminum sheet. Even after heating at 650° F. for 30 minutes, oil staining was negligible - 1 on the rating scale. The oil also provided excellent water stain protection as evidenced by the water stain rating of only 1.

The three-component additive blend was similarly blended at a 6% level in mineral oil. A slight decrease in lubricity (256 units wear with an EP rating of 2,750 lbs.) was observed but excellent water stain protection and resistance to oil stain was still obtained.

Thirty parts methyl stearate and 20 parts mixed saturated fatty alcohols containing predominantly lauryl alcohol were combined with 50 parts of a dibasic acid (96% $C_{36}$ dibasic acid, 3% $C_{54}$ trimer acid and 1% monobasic acid) having an iodine value of approximately 13. This product was blended at three and six percent levels with 40 SUS mineral seal oil to obtain lubricants useful for cold rolling aluminum. The rolling oil composition exhibited excellent lubricity in the Falex test, gave negligible oil stain when heated at 650° F. for 30 minutes and provided an effective hydrophobic barrier on the surface of the metal.

Forty parts EMPOL ® 1010 Dimer Acid containing 97% by weight $C_{36}$ dimer acid, 40 parts lauryl alcohol and 20 parts methyl oleate were blended and a 6% solution prepared therefrom with 40 SUS mineral seal oil. The resulting lubricating composition gave an average stain rating of 1.5 in duplicate tests conducted at 650° C. for 30 minutes. The oil also provided a continuous protective barrier on the surface of the aluminum so that the sheet was effectively protected against the formation of water stain during storage and shipment even under conditions of high humidity. The water stain rating for sheets treated with the oil was only 1. In addition to the aforementioned properties, the rolling oil composition exhibited superior lubricity even under high loads. When methyl stearate was substituted for all or a portion of the methyl oleate in this formulation the lubricating properties were enhanced without detracting from the other desirable properties of the rolling oil.

Fifty parts dimer acid having a maximum iodine value of 35 and containing 87% by weight $C_{36}$ dimer acid was blended with 20 parts lauryl alcohol and 30 parts of a mixture of methyl stearate and methyl palmitate. A six percent solution was prepared with mineral seal oil. The lubricant solution exhibited superior lubricating properties in the Falex test and gave excellent results on a single pass rolling mill with aluminum sheet. A high degree of reduction was obtained using this formulation while obtaining a uniform sheet free from surface defects and surface stain. Even after annealing no undesirable oil stain was evident on the sheet. The rolled sheet thus obtained was also resistant to development of water stain in the steam test. A stain rating of 1 was obtained with the 4% rolling oil solution and when the additive level was increased to 6%, no water staining was observed. The composition also provided effective lubrication in other metal working operations involving aluminum and aluminum alloys.

I claim:

1. A rolling oil composition consisting essentially of an aliphatic or aromatic hydrocarbon oil having a 100° F. viscosity of 20 to 100 SUS and 1 to 20 weight percent of a lubricant additive containing:

(a) from about 25% to 65% by weight dimer acid containing greater than 75% by weight $C_{36}$ dibasic acid and having a maximum iodine value of 35;

(b) from about 15% to 45% by weight of a saturated fatty alcohol having 8 to 20 carbon atoms; and (c) from about 15% to 45% by weight of a lower alkyl ester of a fatty acid having from 12 to 18 carbon atoms.

2. The rolling oil composition of claim 1 wherein the hydrocarbon oil has a 100° F. viscosity between about 25 and 60 SUS.

3. The rolling oil composition of claim 2 wherein the lubricant additive is present in an amount from 3 to 10 weight percent and contains 30% to 60% by weight (a), 20% to 40% by weight (b), and 20% to 40% by weight (c).

4. The rolling oil composition of claim 3 wherein the dimer acid (a) contains more than 90% by weight $C_{36}$ dibasic acid and has a maximum iodine value of 20, the fatty alcohol (b) contains 10 to 18 carbon atoms and the alkyl ester (c) is a methyl ester of a $C_{14-18}$ fatty acid.

5. The rolling oil of claim 4 wherein the hydrocarbon oil is mineral oil or mineral seal oil.

6. The rolling oil composition of claim 5 which is further characterized by having an acid value less than 10, 210° F. viscosity of 0.5 to 2 centistokes, 100° F. viscosity of 8 to 12 centistokes, flash point greater than 260° F., fire point greater than 290° F., and pour point above −50° F.

7. A process for cold rolling and aluminous metal which comprises applying to the surface of said metal an effective lubricating amount of a rolling oil composition consisting essentially of an aliphatic or aromatic hydrocarbon oil having a 100° F. viscosity of 20 to 100 SUS and 1 to 20 weight percent of a lubricant additive containing:

(a) from about 25% to 65% by weight dimer acid containing greater than 75% by weight $C_{36}$ dibasic acid and having a maximum iodine value of 35;

(b) from about 15% to 45% by weight of a saturated fatty alcohol having 8 to 20 carbon atoms; and (c) from about 15% to 45% by weight of a lower alkyl ester of a fatty acid having from 12 to 18 carbon atoms.

8. The process of claim 7 wherein the hydrocarbon oil is mineral oil or mineral seal oil having a 100° F. viscosity between 25 and 60 SUS and which contains from 3 to 10 weight percent of the lubricant additive consisting of 30% to 60% by weight of a dimer acid containing more than 90% by weight $C_{36}$ dibasic acid and having a maximum iodine value of 20, 20% to 40% by weight of a fatty alcohol having 10 to 18 carbon atoms and 20% to 40% by weight of a methyl ester of a $C_{14-18}$ fatty acid.

9. The process of claim 8 wherein said rolling oil is applied between the roll and the aluminous metal.

* * * * *